US006902125B2

(12) United States Patent
Schneider

(10) Patent No.: US 6,902,125 B2
(45) Date of Patent: Jun. 7, 2005

(54) PROCESS AND DEVICE FOR DISINTEGRATING IRREGULARITIES IN FLOWS OF WOOD FIBRES

(75) Inventor: Fritz Schneider, Hohenzolllernstrasse 56, Krefeld (DE), D-47799

(73) Assignees: Fritz Schneider, Krefeld (DE); Flakeboard Company Limited, St. Stephen (CA)

( * ) Notice: Subject to any disclaimer, the term of this patent is extended or adjusted under 35 U.S.C. 154(b) by 0 days.

(21) Appl. No.: 10/304,044

(22) Filed: Nov. 25, 2002

(65) Prior Publication Data

US 2003/0066168 A1 Apr. 10, 2003

Related U.S. Application Data

(63) Continuation of application No. PCT/EP01/05729, filed on May 18, 2001, and a continuation of application No. PCT/EP01/09212, filed on Aug. 9, 2001.

(30) Foreign Application Priority Data

| | | |
|---|---|---|
| May 24, 2000 | (DE) | 100 25 177 |
| Aug. 11, 2000 | (DE) | 100 39 226 |
| Dec. 8, 2000 | (DE) | 100 61 072 |

(51) Int. Cl.[7] ..... B07B 4/02
(52) U.S. Cl. ..... 241/28; 241/221
(58) Field of Search ..... 241/24.2–28, 79, 241/185.5, 221; 264/109, 115

(56) References Cited

U.S. PATENT DOCUMENTS

| | | | |
|---|---|---|---|
| 2,737,997 A | 3/1956 | Himmelheber et al. | 154/1 |
| 2,741,191 A | 4/1956 | Fahrni | 104/178 |
| 2,744,848 A | 5/1956 | Mottet | 154/101 |

(Continued)

FOREIGN PATENT DOCUMENTS

| | | | |
|---|---|---|---|
| DE | 1078759 | 8/1955 | |
| DE | 1 089 540 | 6/1956 | B27N/3/81 |
| DE | 3731322 A1 | 9/1986 | B65G/47/14 |
| DE | 38 18 117 A1 | 11/1989 | B27N/3/00 |
| DE | 44 39 653 A1 | 5/1996 | B27N/3/00 |
| DE | 43 02 850 C2 | 7/1998 | B27N/3/00 |
| DE | 197 18 158 A1 | 11/1998 | B07B/7/02 |

(Continued)

OTHER PUBLICATIONS

Holzspanwerkstoffe Professor Dr.–Ing. Franz Kollmann p. 310–3. Allegmeine Technologie der Spanplattenherstellung p. 511–5.1 Flachpreβverfahren Published 1966.

Modern Patricleboard & Dry–Process Fiberboard Manufacturing by Thomas M. Maloney Nov. 15, 1978; pp. 439–440.

"Leimverlusten auf der Spur" MDF–Magazin 1999 by Von Paul Buchholzer.

International Search Report dated Nov. 23, 2001 from PCT/EP01/09212; 2 pages.

*Primary Examiner*—Lowell A. Larson
(74) *Attorney, Agent, or Firm*—Synnestvedt & Lechner LLP

(57) ABSTRACT

Wood fibers (2) which are used in the production of fiberboards are supplied from a metering device (1) through a feed chute (7) lo a disintegration roller (12) comprising a plurality of pins (13) on its surface. The disintegration roller (12) rotates at high speed, in such a way that the pins (13) deflect the fibers (6) hitting the disintegration roller (12). The fibers are entrained (6) by the pins (13) and fed through a chute section (17) formed by a partial section (15) of the roller periphery and a wall (16) lying opposite the latter, to an outlet orifice (18) of the chute section (17). Either a forming belt (19) of a forming machine is located beneath the outlet orifice (18), or the fibers (6) pass the outlet orifice (18) into the air duct of an air fiber sifter. The disintegration roller (12) disintegrates irregularities in a fiber stream (6), e.g. fiber bundles, or drops of condensed water.

30 Claims, 4 Drawing Sheets

U.S. PATENT DOCUMENTS

| | | | | | |
|---|---|---|---|---|---|
| 3,214,311 | A | | 10/1965 | Schwab et al. | 156/62.8 |
| 3,896,536 | A | | 7/1975 | Keller et al. | 29/211 R |
| 4,322,380 | A | * | 3/1982 | Bleymaier et al. | 264/438 |
| 4,865,798 | A | * | 9/1989 | Henschel et al. | 264/518 |
| 5,375,780 | A | * | 12/1994 | Gray et al. | 241/28 |
| 5,397,067 | A | * | 3/1995 | Akiyama et al. | 241/28 |
| 5,827,566 | A | | 10/1998 | Epple et al. | 427/8 |

FOREIGN PATENT DOCUMENTS

| | | | | |
|---|---|---|---|---|
| DE | 197 40 676 A1 | 3/1999 | ..... | B27N/1/00 |
| DE | 19930800 | 2/2000 | ..... | B27N/1/02 |
| EP | 0744259 | 11/1996 | ..... | B27N/1/02 |
| EP | 0 800 901 A1 | 10/1997 | ..... | B27N/1/00 |
| WO | WO 92/05882 | 4/1992 | ..... | B07B/4/02 |
| WO | WO 99/11441 | 3/1999 | ..... | B27N/3/14 |

* cited by examiner

PROCESS AND DEVICE FOR DISINTEGRATING IRREGULARITIES IN FLOWS OF WOOD FIBRES

CROSS REFERENCE TO RELATED APPLICATIONS

This application is a Continuation of International Applications PCT/EP01/05729 filed May 18, 2001 and PCT/EP01109212 filed Aug. 9, 2001, both of which are hereby incorporated by reference. PCT Publications WO 01/89783 A1 and WO 02/114038 A1, the respective publications of the above identified PCT applications, are also hereby incorporated by reference. Foreign priority is claimed to German Patent applications DE 100 25 177.3 filed May 24, 2000, DE 100 39 226.1 filed Aug. 11, 2000 and DE 100 61 072.2 filed Dec. 8, 2000, all three of which are hereby incorporated by reference.

BACKGROUND

The invention relates to processes and devices for disintegrating irregularities in flow of wood fibers that are discharged from a metering device and designated for the production of fiberboards.

When producing MDF or HDF boards, if the fibers are glued in a wet state, the consumption of glue is relatively high because part of the reactivity of the glue is lost during the drying process of the fibers due to the high temperatures. Consequently, the emission of formaldehyde, originating from the glue, is considerable in the drying system, thus necessitating a costly minimizing of harmful substances.

If the fibers are not glued in gluing machines until after the drying process, it is possible to reduce the glue consumption and the emission of formaldehyde, however, bundles of fibers, drops of condensed water or lumps of glue are created in the fiber flow, in this so-called "dry-gluing process" or "mechanical gluing". Such irregularities in the fiber flow, which also occur Tao lesser extent when gluing in the wet state, lead to defects in the finished board and therefore can result in rejects.

In order to cover these defective areas, it is known, to glue the fibers of outer layers of fiberboards to be produced while wet and fibers of inner layers in a dry state. This, however, makes the production of fiberboards expensive.

It is also known from general practice to use a hammer mill to break up lumps of fibers that have formed, for example, due to condensed water. Such a hammer mill, however, rapidly becomes soiled and is not very effective.

Rollers, which can be used to disintegrate irregularities in a fiber flow are known per se from DE 38 18 117 A1, DE 44 39 653 A1 and from WO 99/11441. However, the effectiveness of these rollers is limited with respect to disintegrating irregularities.

EP 0 800 901 A1 describes a device for producing a mat in particular from chips where rollers are provided which in conjunction with a downstream air sifter are used to separate the chips based on their size, in order to achieve a distribution of sizes over the mat thickness. In the case of particulate material in the form of fibers it is not possible to achieve a satisfactory disintegrating effect using such rollers. In the case of fiberboards, owing to the desired homogeneity in the structural constitution there is no desire to separate the fibers into different size particles.

DE 43 02 850 C2 describes a generic process and a generic device. The compacted particulate material is disintegrated by means of two rollers which are rotating in opposite directions at different speeds and which grip into each other and as a consequence comprise disintegration teeth which form a serpent-like splitting space. A plurality of distributing rollers are provided downstream for the purpose of distributing the fibers. However, this process is extremely costly.

The object of the invention is to provide a generic process which is extremely effective and not very expensive. Moreover, the object of the invention is to provide a generic device with which such a process can be performed.

SUMMARY OF THE INVENTION

The object is achieved with respect to the process by a process for disintegrating irregularities in a flow of wood fibers that are discharged from a metering device and designated for the production of fiberboards. The fibers which can be in particular fibers glued in a dry state are supplied from the metering device which can in particular be a metering bin, through a feed chute to a disintegration roller which is provided on its surface with a plurality of pins and rotates such that the fibers are deflected by the pins. As a consequence, the fibers are carried substantially along a chute section which is defined by a partial section of the periphery of the disintegration roller and an opposite wall, before they exit at an outlet orifice of the chute section. After exiting from the outlet orifice of the chute section, the fibers move to a forming belt of a forming machine in which the fibers are formed into a mat. The forming belt is a screen belt through which the fibers are drawn via suction to the surface of the forming belt.

The disintegration roller rotates at a high rotational speed. In preference, the chute section is suitable, owing to its shape, chute depth and chute length, for changing the rate of the fiber flow, after an initial influence of the pins on the fibers, during further progression prior to arriving at the outlet orifice by means of the air flow produced in the chute section, to almost the peripheral speed of the disintegration roller, wherein the fibers lie against the wall of the chute section. The disintegrated fibers exit in the form of a thin fiber flow drawn out preferably to form a millimeter thin film from the chute section and then pass into a distributing chamber where they are formed with elements of the forming machine into a particulate material mat or web.

It has been shown in practice that the fibers, after impinging on the disintegration roller, even after moving a quarter of the roller periphery, move out of the effective region of the pins and then lie against the wall of the chute section due to the radial force that acts on the fibers by means of rotation. For the remaining stretch of the chute section the fibers are transported by the air flow, which is likewise set in rotation by the roller and moved to the outlet orifice of the chute section. The wall of the chute section comprises a smooth surface preferably on its side opposite the disintegration roller.

Bundles of fibers and drops of condensed water are disintegrated in the fiber flow extremely effectively by deflecting the fiber flow or by contact with the rapidly rotating pins. Even the per se extremely hard lumps of glue are disintegrated to a specific extent. Therefore, a homogenized fiber flow exits from the outlet orifice of the chute section, through which the fibers are distributed onto the forming belt. Thus, with the very effectively reduced number of irregularities in the fiber flow and the avoidance of strips and flecks of different gross densities associated with such irregularities in the fiberboards produced from the fiber flow, the number of reject fiberboards is also considerably reduced and the technological characteristics of the end product, in particular the surface condition, are improved. In particular, the process in accordance with the invention can eliminate the said disadvantages of the glue-saving and low emission dry gluing procedure in the production of fiberboards or with respect to the lumps of glue reduce such disadvantages. Moreover, the process as described in particular also serves the purpose of distributing the fibers to form a mat on the forming belt of the forming machine.

An outlet direction of the fiber flow can be provided which is horizontal or inclined slightly upwards, i.e. in the direction of the metering device.

As the fibers exit the chute section, they can be directed through a profiled section which comprises nail-like protrusions and is disposed across the width of the outlet orifice. Hereinunder the profiled section comprising nail-like protrusions is described as a combing strip. The combing strip is used to continue the process of disintegrating the irregularities in the fiber material and thus according to the specific structure of the combing strip provides an increased level of fineness of the fiber material. After the fibers have passed through the combing strip, which quasi represents the second stage of the fiber disintegration, an even more homogenized fiber flow exits the chute section.

Preferably, the nail-like protrusions of the combing strip can be adjusted at an angle with respect to the direction of flow of the fibers. In particular, an angle of 135° between the nail-like protrusions and the flow direction of the impinging fibers has proved to be extremely advantageous. However, for example, an arrangement of the protrusions perpendicular to the flow direction is also possible.

In particular, where the combing strip is at the preferred angle position of 135°, the fibers are deflected obliquely upwards in the direction of the pins of the disintegration roller. In this manner, the fibers pass once again into the effective region of the pins and are thus subjected to a further process for disintegrating the irregularities.

In principle, the fibers are decelerated as they impinge on the nail-like protrusions, which produces a swirling effect even when the combing strip is disposed in a vertical arrangement. This swirling effect can return the fibers to the effective region of the pins of the disintegration roller. The nail-like protrusions can be disposed in a plurality of rows, also offset with respect to each other.

By means of the level of suction which can be adjusted across the width of the belt, the distribution of the weight of the fibers can be adjusted across the width. Moreover, in addition to the gravitational force in the direction of the disintegration roller, the suction process accelerates the fibers discharged by the metering device. This enhances the effectiveness of the disintegration roller with respect to disintegrating the irregularities in the fiber flow. Preferably, the rate at which the fibers move in the feed chute towards the disintegration roller can be adjusted by changing the cross-section of the feed chute and the suction rate.

It is possible below the outlet orifice of the chute section to provide an air flow which has been produced by the suction process and has a speed component which is directed in parallel with the forming belt, which air flow ensures that the fibers roll off as little as possible when they impinge on the forming belt, i.e. as far as possible assume the speed of the forming belt without any deceleration.

This can be supported by arranging the outlet orifice of the chute section such that it ejects the fibers in a manner substantially in parallel with the forming belt.

The object is achieved with respect to the process moreover by the features of the invention which provides a process for disintegrating irregularities in a flow of wood fibers that are discharged from a metering device and designated for the production of fiberboards, wherein the fibers are supplied by the metering device through a feed chute to a disintegration roller which is provided on its surface with a plurality of pins and rotates such that the fibers are deflected by the pins and are guided whilst the fiber flow is being drawn apart to form a thin film substantially along a chute section, which is defined by a partial section of the periphery of the disintegration roller and an opposite wall, and exit at an exit outlet of the chute section in a substantially horizontal manner, and that the fibers after exiting the chute section are sifted, in that an air flow directed upwards and produced by negative pressure acts on the fibers, entrains fibers, and impurities in the form of coarse material are supplied by means of the gravitational force to a coarse material outlet. Here the fibers are supplied from the outlet orifice of the chute section to an air-fiber sifting process. The fibers exit substantially horizontally from the chute section and pass into an air flow which is directed upwards and produced by means of a negative pressure. The air flow drags fibers along which, as desired, are lying singularly and thus as a particle have a relatively low weight, whereas the irregularities in the form of coarse material are supplied by the gravitational force to a coarse material outlet. In so doing, the coarse material can be deflected vertically downwards to the coarse material outlet by means of a flap, the angle of which flap can be adjusted. In accordance with another embodiment of the invention, in place of the upwardly directed air flow, it is also possible to provide a downwardly directed air flow, which is directed in the opposite direction of the rotational direction of the disintegration roller. In this case, an adjustable deflector is disposed in such a manner that the coarse material is deflected into the coarse material discharge chute.

In preference, the fibers which are of above average weight and are not directly carried off by the upwardly directed air flow are raised in a secondary sifter disposed upstream of the coarse material outlet into the air flow by means of an additional secondary sifting air flow which is directed upwards and produced by negative pressure.

In the case of the air-fiber sifting, the effect of the disintegration roller in addition to disintegrating the irregularities is to accelerate and thus draw apart the fiber flow, as a consequence enhancing the sifting effect. The fiber flow is pulled apart to form a thin film. Moreover, a mechanical pre-separation of heavy particles from the fiber flow is performed prior to said fiber flow passing into the air flow of the fiber sifting process. The pre-separation is performed owing to the different trajectory parabolas of heavy and light particles. The heavy particles include in particular also lumps of glue and glue pieces, which owing to their hardness were not disintegrated by the disintegration roller.

In the case of the two processes in accordance with the invention, it can also be possible to add additives to the fibers in the feed chute via nozzles. The disintegration roller then not only has the function of disintegrating but also of mixing.

The disintegration roller, whose rotational speed can preferably be adjusted, rotates rapidly, e.g. at approx. 300 to 2000 rpm. In preference, it comprises a diameter from 500 to 600 mm and rotates at 300 to 2000 rpm.

In particular, it can be provided that the fibers are first subjected to a disintegration process and air-fiber sifting in accordance with either the upwardly or downwardly directed air flow embodiment previously discussed using a corresponding disintegration device in accordance with the invention and subsequently, after being transported pneumatically in accordance with the process for disintegrating irregularities in a flow of wood fibers as discussed in the beginning of this summary section, are supplied, for the purpose of forming a mat, via a metering device to a further corresponding disintegration device in accordance with the invention which has an integrated forming machine. By virtue of the air-fiber sifting, in particular lumps of glue, glue pieces and coarse wood particles, which are created when manufacturing the fibers, are removed from the fiber flow. A part of the residual heavy parts which manage to pass through the air-fiber sifting, in particular lumps of fiber which can have reformed whilst being transported from the air-fiber sifting process to the metering bin outlet of the other disintegration device in accordance with the invention which has an integrated forming machine, is disintegrated by means of this further disintegration device. As a consequence, the fiber mat to be formed is provided with an improved structural constitution by homogenizing the fiber material.

The outlet orifice of the chute section can be disposed in such a manner that it discharges the fibers in a substantially horizontal manner and thus in parallel with the forming belt and moreover in the direction of movement of the forming belt, and as a consequence residual heavy parts, which have passed through the air-fiber sifting process, are transported by means of a mechanical separating effect, which the disintegration roller of the disintegration device comprising the integrated forming machine also has, in the forming machine during construction of the mat into an upper layer of the fiber mat. The upper layer of the fiber mat, approx. 25% of the total mat height, is preferably combed off by means of a downstream scalping roller and transported pneumatically to a process at the beginning of the air-fiber sifting process, preferably in a metering bin within the air-fiber sifting process. Thus, a partially secondary sifting process is performed following the first fiber sifting process.

The object is achieved with respect to the device by virtue of the features of a device for disintegrating irregularities in a flow of wood fibers that are discharged from a metering device and designated for the production of fiberboards, wherein below an outlet of the metering device a feed chute extends from the outlet to a disintegration roller which comprises on its surface a plurality of pins and can rotate in such a manner that the fibers impinging on the disintegration roller are deflected by the pins and that a chute section which is defined by a partial section of the roller periphery and an opposite wall extends from an outlet orifice of the feed chute in the direction of rotation of the disintegration roller and is provided with an outlet orifice, which is aligned preferably in a substantially horizontally manner, for the fibers and that below the outlet orifice of the chute section is disposed a forming belt of a forming machine, wherein the forming belt is a screen belt and below said belt are disposed vacuum boxes for the purpose of drawing via suction the fibers to the surface of the forming belt. Below a discharge outlet of the metering device extends a feed chute from the discharge outlet to a disintegration roller, which comprises on its surface a plurality of pins and can be rotated such that the fibers impinging on the disintegration roller are deflected by means of the pins. A chute section, which is delimited by a partial section of the roller periphery and an opposite wall, extends from an outlet orifice of the feed chute in the direction of rotation of the disintegration roller.

Below the discharge orifice of the chute section is disposed a forming belt, preferably at a distance of 200 to 500 mm, in particular from 220 to 280 mm. The forming belt is a screen belt, below which are disposed vacuum boxes for the purpose of drawing the fibers via suction to the surface of the forming belt, preferably for influencing the area weight distribution with an adjustable thickness.

Essentially, the same advantages as mentioned in connection with the process described above in the beginning of the summary section are achieved in the case of the device. Owing to the rotational movement of the disintegration roller, the fibers are accelerated to form a thin, preferably millimeter-thin fiber flow which moves at a great rate towards the outlet orifice of the chute section, wherein the fiber flow is directed by the wall of the chute section until the fibers are discharged out of the outlet orifice.

Preferably, one combing strip having at least one row of nail-like protrusions is disposed at the outlet orifice of the chute section across the working width of the chute section. The length of the nail-like protrusions is selected such that the entire fiber flow must pass the combing strip prior to exiting the outlet orifice of the chute section. As described above, this causes a further disintegration of the fiber material.

The degree of fineness of the combing strip can be varied by means of appropriately selecting the thickness of the nail-like protrusions and the number of these protrusions.

The combing strip can be designed and disposed such that, apart from the fibers being disintegrated as they impinge on the nail-like protrusions, the direction of the fiber flow is simultaneously changed. This change in direction is produced such that the fibers, which have been removed from the effective region of the pins by means of the centrifugal force of the rotational movement in the chute section after a partial stretch of the chute section are returned to the effective region of the pins.

As the friction at the combing strip has a decelerating effect on the fibers, the fibers are as a consequence grasped and overtaken after the combing strip in the flow direction by the pins of the rotating disintegration roller and whilst being discharged from the outlet orifice of the chute section they are subjected to a further disintegration process.

This disintegration device provides a device which, with only one single rotating roller having pins and with a chute section having an integrated combing strip at its outlet orifice, disintegrates the fiber material in at least two stages of different degrees of fineness, first finely and then most finely, and simultaneously the device has the characteristic in conjunction with the intake air of the vacuum boxes and of the screen belt to form a homogenous fiber mat of a constant area weight.

A supply orifice for an air flow having a speed component which is directed in parallel with the forming belt can be provided between the outlet orifice of the chute section and the forming belt. The small spacing between the outlet orifice of the chute section and the forming belt and the air flow directed in parallel with the forming belt prevent the fibers from contacting the forming belt at a relatively high speed.

The vertical extension of the air flow supply orifice can be varied across the width of the forming belt by means of a plurality of metal plates which can be height adjusted independently from each other, in order to be able to set a specific air supply symmetry and in this manner the height at which the fibers are laid down across the width of the forming belt can be influenced.

By virtue of a guide wall which is adjacent to the outlet orifice of the feed chute opposite the chute section and can extend in a section which runs in parallel with the forming belt, a suction effect of the vacuum below the screen belt is also exerted on the fibers which are located in the feed chute. It is advantageous for the flow conditions if a projection directed towards the disintegration roller is formed at the transition site where a feed chute wall becomes the guide wall, which projection forms only one narrow through-passage for the fibers at the partial section of the disintegration roller lying opposite the chute section. Moreover, the cross-section of the feed chute can be varied in order to be able to influence the rate of progression of the fibers along the feed chute. The rate of progression of the fibers in the feed chute in relation to the peripheral speed of the rotating disintegration roller determines the depth of penetration of the fibers in the disintegration roller before they are grasped by the pins and deflected. Thus, the rate of progress of the fibers in the feed chute determines the extent to which the fibers are disintegrated and simultaneously the acceleration of the fibers.

The object with respect to the device is also achieved by virtue of the features of the invention providing a device for disintegrating irregularities in a flow of wood fibers that are discharged from a metering device and designated for the production of fiberboards, wherein below an outlet of the metering device a feed chute extends from the outlet to a disintegration roller which comprises on its surface a plurality of pins and can rotate in such a manner that the fibers impinging on the disintegration roller are deflected by the pins and that a chute section which is defined by a partial section of the roller periphery and an opposite wall extends from an outlet orifice of the feed chute in the direction of rotation of the disintegration roller and is provided with an outlet orifice for the fibers, which outlet is disposed in such a manner that the fibers exit into an air duct substantially horizontally in a fiber flow which has been drawn apart, which air duct carries an air flow which is directed by means of a negative pressure, wherein a coarse material discharge chute, which comprises an inlet opposite the outlet orifice of the chute section and a coarse material outlet which is disposed below the inlet, is connected to the air duct. Accordingly, a disintegration device is provided with an integrated air-fiber sifter, wherein the above described outlet orifice of the feed chute is disposed in such a manner that the fibers exit in a substantially horizontal manner into an air duct which guides an air flow which is produced by negative pressure and is directed upwards or downwards, wherein a coarse material discharge chute, which comprises an inlet lying opposite the outlet orifice of the feed chute and a coarse material outlet disposed below the inlet, is connected to the air duct. The fiber flow is drawn apart by the disintegration roller owing to acceleration, which improves the sifting effect. The disintegration roller preferably has a variable rotational speed. As a consequence, the speed at which the fibers are ejected from the chute section can be varied, which influences the trajectory parabola in particular of the large particles, which are to pass into the coarse material chute during the sifting process.

In the case of an upwardly directed air flow, it is possible to dispose an angularly adjustable flap at the inlet of the coarse material discharge chute in such a manner that the coarse material is deflected into the coarse material discharge chute. In the case of a downwardly directed air flow, an adjustable deflector can be arranged in such a manner that the coarse material is deflected into the coarse material discharge chute.

In the case of disintegration devices which have an integrated air-fiber sifter, a combing strip is not provided, since a deceleration of the fiber flow which this would cause is not desired.

In preference, the coarse material discharge chute comprises at least one air supply orifice in a lower region, through which an upwardly directed air flow for secondary sifting of above-average weight fibers is produced by virtue of the negative pressure prevailing at the air duct.

In the case of all devices in accordance with the invention it is preferably provided that the pins of the disintegration roller taper in a conical manner with an increasing spacing with respect to the rotational axis of the roller. The wall of the chute section can in particular be formed by a hood, which can be adjusted with respect to the disintegration roller, so that the distance of the wall to the outer ends of the pins can be varied. The distance is relatively small so that the fiber flow starting from the outlet orifice of the feed chute in a first section of the chute section is held in the effective region of the disintegration roller. Further along the chute section the fiber flow, after it has been subjected to the first stage of fiber disintegration, passes by virtue of the centrifugal force of the rotational movement in the chute section out of the effective region of the disintegration pins and contacts the wall of the chute section. In order to protect the disintegration roller it is possible to install in the feed chute electromagnets or permanent magnets for the purpose of extracting metal particles from the fiber flow.

A row of nozzles can be disposed in the feed chute, by means of which nozzles additives, for example, water, hot steam, accelerators or retarders, can be added to the fibers being discharged from the metering device.

As explained for the process, it is possible in particular to dispose a disintegration device having an air-fiber sifter and a disintegration device having a forming machine one behind the other.

BRIEF DESCRIPTION OF THE DRAWING

Hereinunder, the invention will be explained in detail with reference to two exemplified embodiments and the drawings, in which.

DETAILED DESCRIPTION

Figure 1:
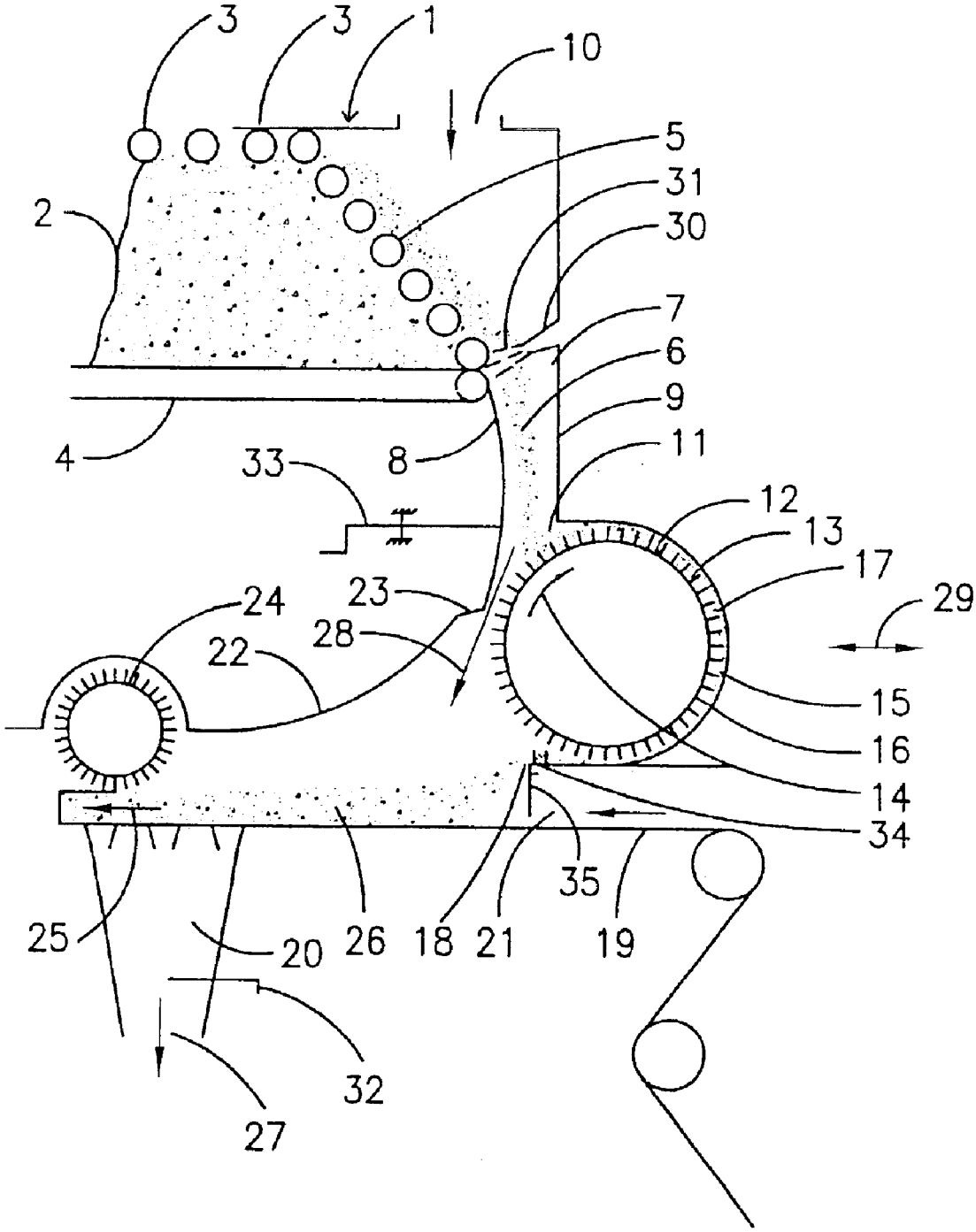
FIG. 1 illustrates schematically a partial view of a disintegration device having an integrated forming machine.
Figure 2A:
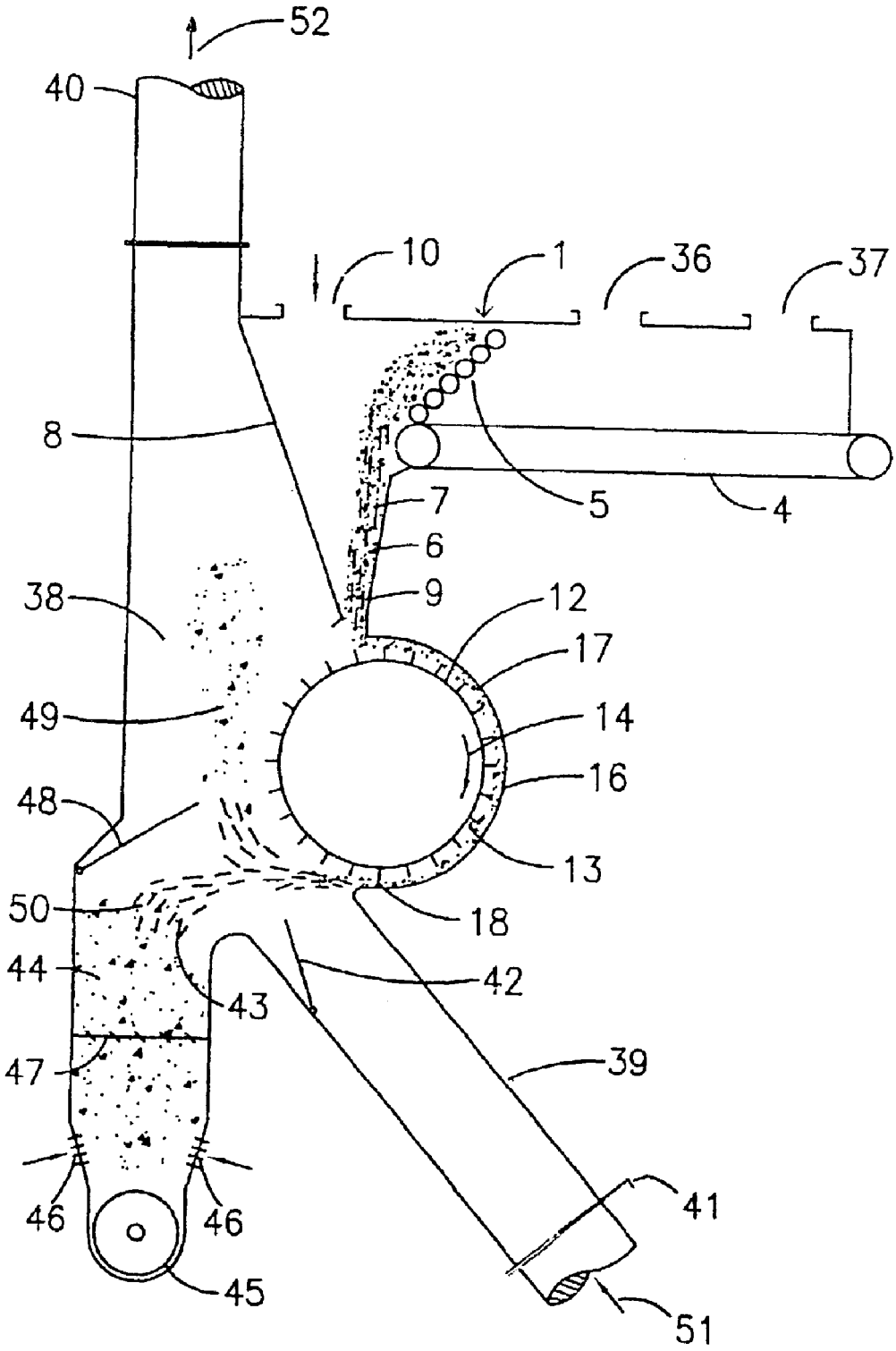
FIG. 2*a* illustrates schematically a partial view of a disintegration device for the purpose of mechanically pre-separating heavy particles comprising an integrated air-fiber sifter with an upwardly directed air flow.
Figure 2B:
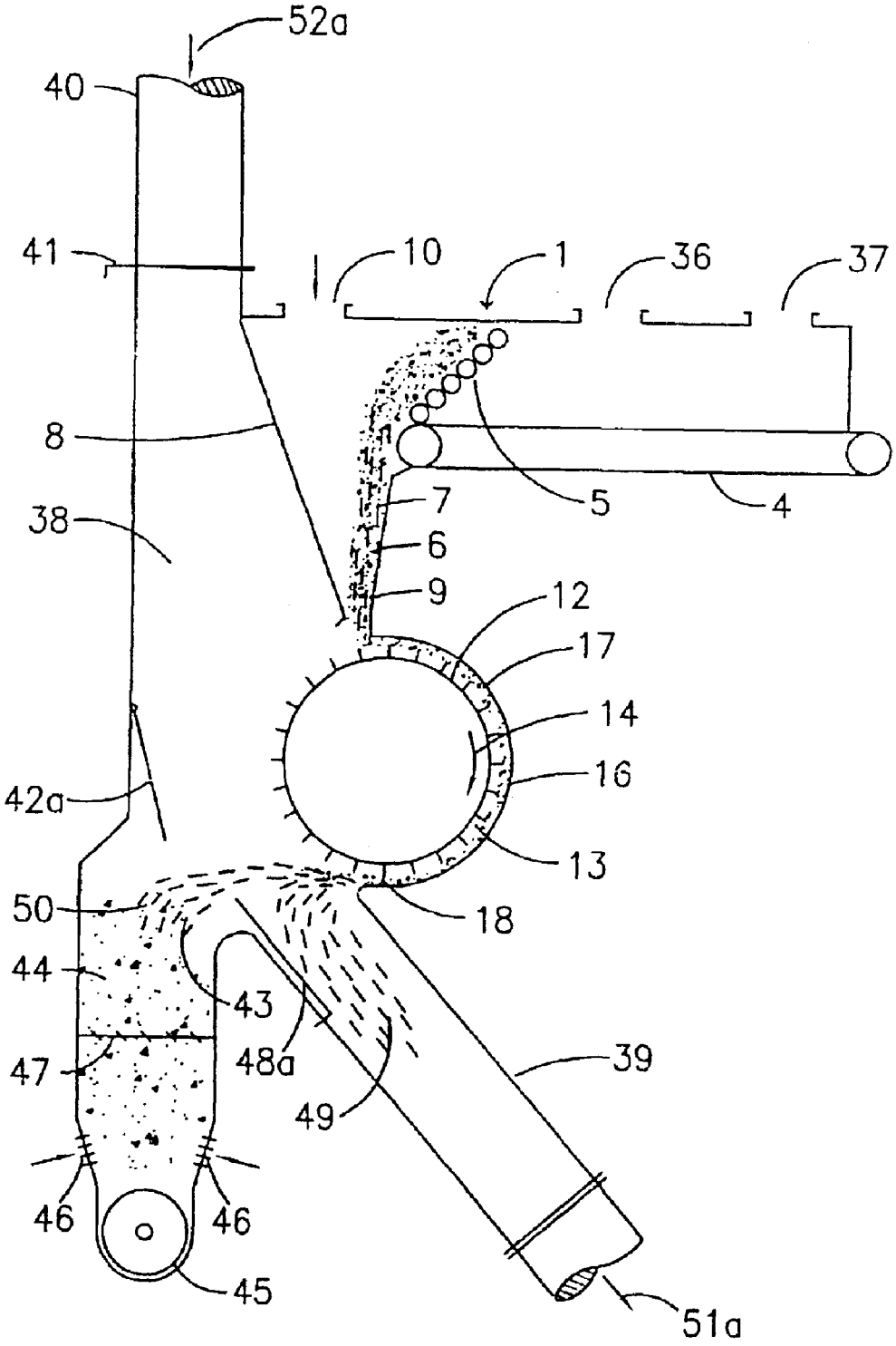
FIG. 2*b* illustrates schematically a partial view of a disintegration device for mechanically pre-separating heavy parts comprising an integrated air-fiber sifter with a downwardly directed air flow.

The disintegration device in accordance with FIG. 1 could also be described as a forming machine with an integrated disintegration device and the disintegration devices in accordance with FIGS. 2*a* and 2*b* could be described as air-fiber sifters with an integrated disintegration device.

The disintegration device with an integrated forming machine in accordance with FIG. 1 comprises a metering bin 1 which contains wood fibers 2 which have been glued in a dry state. The upper region of the metering bin 1 is provided with a row of supply rollers 3 which serve to distribute in the metering bin the fibers which are supplied through a metering bin inlet [not illustrated]. By means of a metering belt 4 and a row of discharge rollers 5 disposed at the front side, the fibers 2 are discharged from the metering bin 1. Simultaneously, larger lumps of fibers 2 are disintegrated by virtue of the discharge rollers 5.

The fibers 2 fall from the metering bin 1 as a fiber flow 6 into a feed chute 7 which is defined by two forming walls 8 and 9. A first air supply orifice 10 is located at the upper end of the feed chute 7. Moreover, a row of nozzles 30 is disposed at the forming wall 9 across the width of the fiber flow 6 and the additives 31 can be sprayed onto the fibers of the fiber flow 6 by means of these nozzles.

In the region of an outlet orifice 11 of the feed chute 7 the fiber flow 6 contacts a disintegration roller 12 whose surface is provided with a plurality of pins 13 which taper in a conical manner to form a point with an increasing spacing with respect to the rotational axis of the disintegration roller 12. The disintegration roller 12 comprises a diameter of 550 mm and rotates at approx. 1000 rpm in the rotational direction indicated by the arrow 14. The rotational speed of the disintegration roller 12 is adjustable and can therefore be adjusted to suit the different materials to be disintegrated. Overall, approx. 6000 pins are disposed on the disintegration roller 12, which is designed for a process width of 1500 mm.

A partial section 15 of the disintegration roller periphery and a wall 16 formed by a hood which can be adjusted with respect to the disintegration roller 12 define a chute section 17 which extends approximately from the outer orifice 11 of the feed chute 7 as far as the lowest point of the disintegration roller 12 and comprises at this point an outlet orifice 18. The direction of movement of the hood is indicated by the arrow 29.

Figure 3:
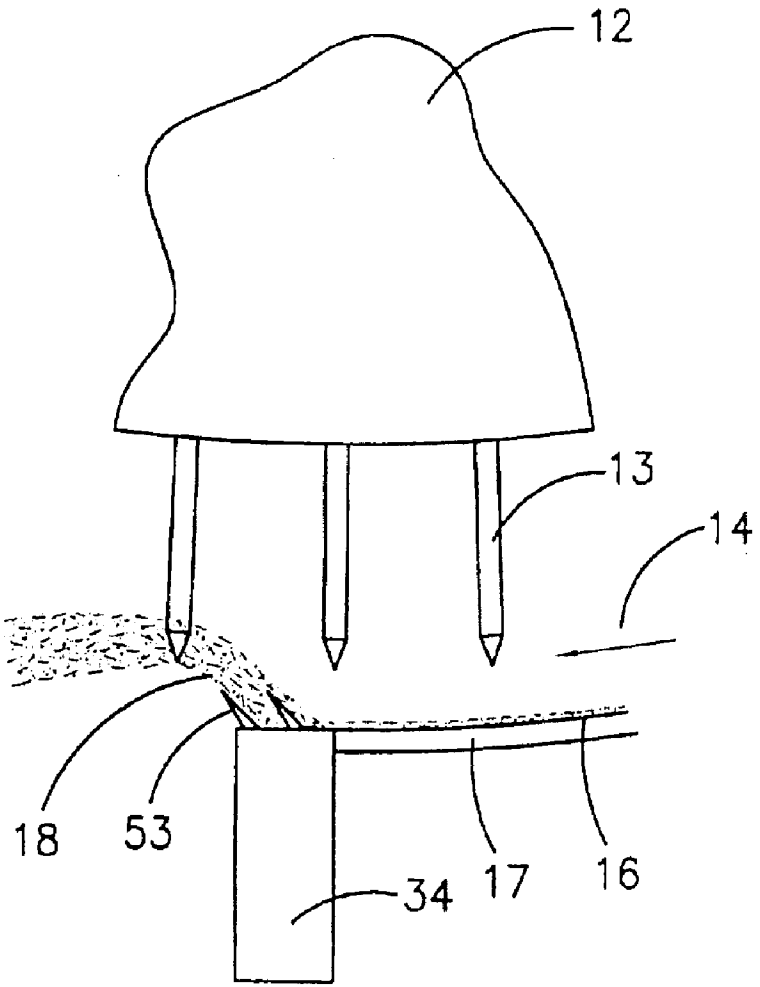
FIG. 3 illustrates schematically a lateral partial view of the outlet orifice 18 of the disintegration device in accordance with FIG. 1.
Figure 4:
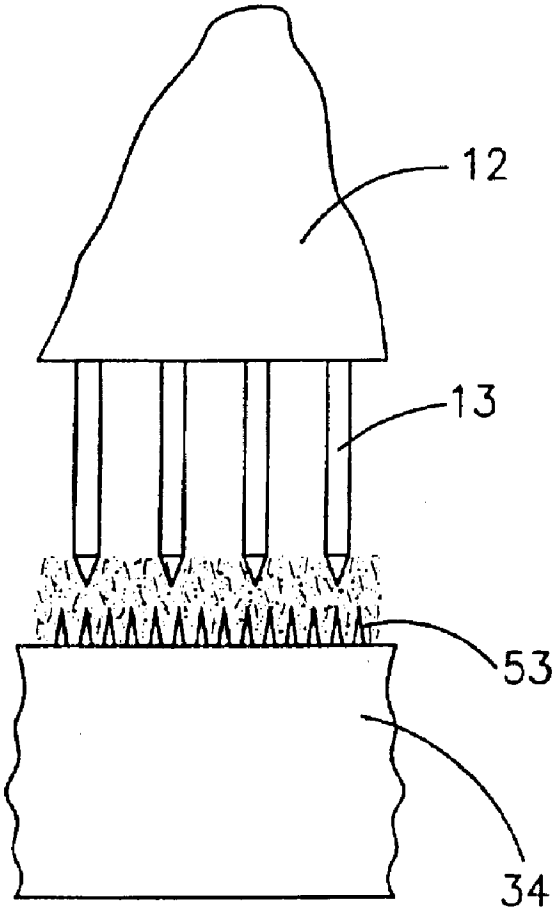
FIG. 4 illustrates schematically a partial plan view of the outlet orifice in accordance with FIG. 3.

At the outlet orifice 18 is provided a combing strip 34, which comprises conical teeth 53 which are angularly adjustable with respect to the flow direction of the fibers. The teeth 53 are disposed in two mutually offset rows across the working width of the chute section 17, as is evident in particular from FIGS. 3 and 4. The teeth 53 are aligned in FIG. 1 in a perpendicular manner with respect to the direction of flow of the fibers and in FIGS. 3 and 4 are inclined such that they form an angle of approximately 135° with the exiting fiber flow.

Below the outlet orifice 18 of the chute section 16 is disposed a forming belt 19 formed as a screen belt. A row of vacuum boxes 20 are located at the underside of the forming belt 19 and are used to produce a negative pressure, indicated by the arrow 27, at the forming belt 19. A slide valve 32 is disposed at each vacuum box 20 for the purpose of adjusting the quantity of air being extracted. A second air supply orifice 21 is located between the outlet orifice 18 of the chute section 17 and the forming belt 19. The vertical extension of the second air supply orifice 21 is variable across the width of the forming belt 19 by means of a plurality of metal plates which are height adjustable independently of each other, of which one is illustrated in FIG. 1 and designated by the reference numeral 35, for the purpose of setting a specific air supply symmetry. For the sake of simplicity, the metal plate 35 is not illustrated in FIGS. 3 and 4.

A guide wall 22 is adjacent to the forming wall 8 of the feed chute 7 and approaches the forming belt 19 at a predetermined distance. A projection 23 is formed at the site where the forming wall 8 becomes the guide wall 22 in such a manner that the through-passage between the forming wall 8 or the guide wall 22 and the disintegration roller 12 is the smallest. The forming wall 8 can be moved in a transverse manner with respect to the feed chute 7 by means of an adjusting shaft 33, for the purpose of adjusting its cross-section or rather the rate of progression of the fiber flow 6 and the air flowing through the feed chute 7.

Above the forming belt 19 is disposed a scalping roller 24. The direction of movement of the forming belt 19 is indicated by the arrow 25.

By virtue of the fact that the fiber flow 6 at the outlet orifice 11 of the feed chute 7 contacts the disintegration roller 12 which rotates at a high rotational speed and the pins 13 comprise a speed component which is at right angles to the direction of movement of the fiber flow 6, intertwining fibers or fibers lumped together are separated from each other and lumps of glue and drops of condensed water are disintegrated. Individual fibers are hardly damaged by the disintegration roller 12. Fibers are initially held in the chute section 17 in the effective region of the disintegration roller 12 by means of the wall 16. The chute section 17 is suitable owing to its shape, chute depth and chute length for bringing the fiber flow during its further progression prior to it reaching the outlet orifice by means of the air flow produced in the chute section 17 up to almost the peripheral speed of the disintegration roller 12.

In this manner, the fibers can be moved towards the outlet orifice 18, where they are decelerated by means of the conical teeth 53 and moved in the direction of the pins 13 and thus in turn moved into the effective region of the disintegration roller 12. As, after the deceleration of the fibers, the pins are moving more rapidly than the fibers, the pins 13 again effect a disintegration of the irregularities in the fiber flow.

Owing to the arrangement of the outlet orifice 18 at the lowest point of the disintegration roller 12 and the air directed through the second air supply orifice 21 in parallel with the forming belt 19, the fibers are moved onto the forming belt 19, without a rolling effect occurring owing to a great difference in speed between the fibers and the forming belt 19 as the fibers contact the forming belt 19. The outlet orifice 18 of the chute section 17 is disposed in such a manner that the fibers under the influence of the air flow indicated by arrow 28 and described below pass onto the forming belt substantially with a movement component in parallel thereto. As a consequence, residual heavy parts, which have passed an upstream air-fiber sifter, e.g. in accordance with FIG. 2*a* or 2*b*, are transported through a mechanical separating effect of the disintegration roller 12 of the forming machine when constructing the mat into an upper layer of the fiber mat. The upper layer of the fiber mat, approximately 25% of the total mat height, is combed off by the downstream scalping roller 24 and can be transported pneumatically into a metering bin of the upstream air-fiber sifter. By means of the height-adjustable metal plates 35 of the second air supply orifice 21, the height at which the fibers are laid across the width of the forming belt 19 can be influenced. The air drawn in through the two air supply orifices 10 and 21 can be conditioned and warmed in order to accelerate a subsequent pressing process.

Fibers which have moved onto the forming belt 19 are drawn via suction on to the surface of the forming belt 19 by means of the vacuum produced below the forming belt. The projection 23 ensures that only a very small quantity of fibers moves onto the forming belt 19 from the fiber flow 6 not through the chute section 17 but rather along the forming wall 8 and the guide wall 22. The through-passage between the projection 23 and the disintegration roller 12 is, however, as indicated by the arrow 28, sufficiently large to allow the passage of air concentrated at the forming wall 8 from the feed chute 7 to the forming belt 19, as a consequence of which the fiber flow 6 can experience, in addition to the gravitational force, a suction effect created by the vacuum prevailing below the forming belt 19. In this manner, the effectiveness of the disintegration roller 12 is increased. In order to increase the guidance of the air along the forming wall 8 and the fibers 6 along the forming wall 9, the forming walls 8 and 9 can also be slightly inclined, for example by 15°.

The scalping roller 24 ensures that a fiber mat formed on the forming belt 19 by the fibers 26 is held constantly at a predetermined mat weight, so that during the pressing process which follows the forming process a fiberboard is held at the most constant weight possible. Further objects of the scalping roller 24 are to produce a planar fiber mat surface, as already mentioned, the combing off of the upper layer of the fiber mat which possibly still contains residual impurities. In the case of the disintegration devices with integrated air-fiber sifters in accordance with FIGS. 2*a* and 2*b*, components which correspond to components of the disintegration device in accordance with FIG. 1 are designated with like reference numerals. Also the disintegration device in accordance with FIG. 2*a* comprises a metering bin 1 with wood fibers [not illustrated]. The wood fibers are supplied to the metering bin 1 either by a dryer [not illustrated] via a first inlet orifice 36 or are directed via a second inlet orifice 37 as return material by a scalping roller [not illustrated] and a side edge [not illustrated] of a forming roller. Discharge rollers 5 direct the fibers in turn as a fiber flow 6 into a feed chute 7 which is defined by two forming walls 8 and 9 and at whose upper end is located a first air supply orifice 10.

An outlet orifice 18 of a chute section 17 issues into an air duct 38 of the fiber sifter. The air duct 38 comprises a lower duct section 39 and an upper duct section 40. In order to produce an air flow indicated by the arrows 51 and 52, air is supplied via the lower duct section 39 and the quantity of this air can be adjusted using an air supply slide valve 41. In the lower duct section 39, in the region where the coarse material sifting occurs, is provided, moreover, an adjusting flap 42 which is used to adjust the flow direction and simultaneously the flow rate of the supplied air. At an upper end of the upper duct section 40 a negative pressure is produced, for example by way of a fan [not illustrated].

An inlet 43 of a coarse material discharge chute 44 is disposed opposite the outlet orifice 18 of the chute section 17. The coarse material discharge chute 44 extends in the vertical direction and comprises at its lower end a coarse material outlet 45. Above the coarse material outlet 45 are disposed third air supply orifices 46. Air regulating flaps 47 are attached across the cross-section of the coarse material discharge chute 44. A coarse material deflector 48 is disposed in the form of an adjusting flap behind the inlet 43.

The disintegration device with an integrated air-fiber sifter is based on the following mode of operation. The fiber flow 6 which is metered onto the disintegration roller 12 and supplied in a guided manner is accelerated by the disintegration roller 12 and as a consequence drawn apart. Impurities are substantially disintegrated or reduced in size. The fibers pass into the air duct 38 as a fiber flow which has been drawn apart. Light normal material 49, i.e. individual fibers of average weight, is thrown over the beginning of a short trajectory parabola owing to its relatively low kinetic energy after exiting the chute section 17 in order then to be carried along by the air flow 51, 52 directed upwards in the air duct 38.

Coarse material 50, which is heavier than the normal material 49, is thrown over a longer trajectory parabola owing to the higher kinetic energy and as a consequence after contacting the coarse material deflector 48 passes into the coarse material discharge chute 44.

A small air flow prevailing in the coarse material discharge chute 44 causes heavy particles of coarse material 50 to drop out of the air flow 51, 52 into the coarse material outlet 45. Fiber particles which are between the light and heavy weight boundary are lifted from the coarse material discharge chute 44 back into the air flow 51, 52 of the air duct 38.

The throughput rate of the air-fiber sifter can amount to approx. 300 g fibers/$m^3$ air with an air flow rate of 20 m/sec in the fiber sifter.

The fibers carried off through the upper duct section 40 can be directed, for example via a cyclone, to a disintegration device comprising an integrated forming machine in accordance with FIG. 1.

In the case of the disintegration device with an integrated air-fiber sifter in accordance with FIG. 2*b*, components which correspond to components of the disintegration device in accordance with FIG. 2*a* are designated with like reference numerals. The disintegration device in accordance with FIG. 2*b* is different from the disintegration device in accordance with FIG. 2*a* substantially by a downwards directed air flow which is indicated by the arrows 51*a* and 52*a*. The downwards directed air flow flows on the side, of the disintegration roller 12, opposite the chute section 17 in a direction which is opposite to the direction of rotation of the disintegration roller 12. The upwardly directed air flow of the disintegration roller 12 in accordance with FIG. 2*a* flows on the other hand in a direction which corresponds to the direction of rotation of the disintegration roller 12. The flaps 42 and 48 of the disintegration device in accordance with FIG. 2*a* are not provided in the disintegration device in accordance with FIG. 2*b*. In the case of the disintegration device in accordance with FIG. 2*b*, a height-adjustable coarse material deflector 48*a*is disposed in such a manner that the coarse material 50 is deflected into the coarse material discharge chute 44, wherein the normal material 49 passes into the lower duct section 39. Moreover, an adjusting flap 42*a* is disposed in the upper duct section 38, in the region where the coarse material is sifted, the said adjusting flap being used to adjust the flow direction and simultaneously the flow rate of the supplied air. Moreover, the position of the air supply slide valve 41 is changed with respect to the disintegration device in accordance with FIG. 2A.

What is claimed is:

1. A process for disintegrating irregularities in a flow of wood fibers that are discharged from a metering device and designated for the production of fiberboards, comprising:

the fibers are supplied by the metering device through a feed chute to a disintegration roller which is provided on its surface with a plurality of pins and which rotates such that the fibers are deflected by the pins and are guided substantially along a chute section which is defined by a partial section of the periphery of the disintegration roller and an opposite wall, wherein the fibers exit at an outlet orifice of the chute section in a substantially horizontal manner and, for the purpose of forming a mat, pass from the outlet orifice to a forming belt of a forming machine, wherein the forming belt is a screen belt and the fibers are drawn via suction on to the surface of the said screen belt.

2. A process according to claim 1, wherein the fibers as they exit the chute section are directed through a profiled section which has nail-like protrusions and is disposed across the width of the outlet orifice.

3. A process according to claim 2, wherein the nail-like protrusions are adjustable in the angle with respect to the direction of flow of the fibers.

4. A process according to claim 2 wherein the nail-like protrusions form an angle of 135° with the direction of flow of the impinging fibers.

5. A process according to claim 2, wherein the nail-like protrusions are disposed in a plurality of mutually offset rows.

6. A process according to claim 2, wherein below the outlet orifice of the chute section is an air flow having a speed component which is directed in parallel with the forming belt.

7. A process according to claim 2, wherein the fibers are ejected out of the outlet orifice of the chute section substantially in parallel with the forming belt and in the movement direction of the forming belt; and wherein heavy residual particles pass into an upper layer of the mat by means of mechanical separation and this layer is combed off by means of a scalping roller.

8. A device for disintegrating irregularities in a flow of wood fibers that are discharged from a metering device and designated for the production of fiberboards, comprising:

wherein below an outlet of the metering device a feed chute extends from the outlet to a disintegration roller which comprises on its surface a plurality of pins and can rotate in such a manner that the fibers impinging on the disintegration roller are deflected by the pins and that a chute section which is defined by a partial section of the roller periphery and an opposite wall extends from an outlet orifice of the feed chute in the direction of rotation of the disintegration roller and is provided with a chute section outlet orifice for the fibers, which is aligned in a substantially horizontally manner, and that below the outlet orifice of the chute section is disposed a forming belt of a forming machine, wherein the forming belt is a screen belt and below said belt are disposed vacuum boxes for the purpose of drawing via suction the fibers to the surface of the forming belt.

9. A device according to claim 8, wherein a profiled section having nail-like protrusions is disposed across the width of the outlet orifice.

10. A device according to claim 9, wherein the nail-like protrusions are angularly adjustable with respect to the direction of flow of the fibers.

11. A device according to claim 9, wherein the nail-like protrusions form an angle of 135° with the direction of flow of the impinging fibers.

12. A device according to claim 9, wherein the nail-like protrusions are disposed in a plurality of mutually offset rows.

13. A device according to claim 8, wherein the spacing between the outlet orifice of the chute section and the forming belt is from 220 to 280 mm.

14. A device according to claim 8, wherein between the outlet orifice of the chute section and the forming belt is provided an air supply orifice for an air flow having a speed component directed in parallel with the forming belt.

15. A device according to claim 14, wherein the vertical extension of the air supply orifice can be varied across the width of the forming belt by virtue of a plurality of mutually independently height-adjustable metal plates.

16. A device according to claim 8, wherein adjacent to the outlet orifice of the feed chute opposite the chute section follows a guide wall which extends into a section extending in parallel with the forming belt and that at a transition site where a feed chute wall becomes the guide wall is formed a projection which is directed to the disintegration roller.

17. A process for disintegrating irregularities in a flow of wood fibers, said process comprising the steps of:

feeding said flow of wood fibers to a spinning disintegrating roller having a plurality of pins extending outwardly therefrom;

deflecting said flow of wood fibers through contact with said pins;

directing said deflected wood fibers along a chute which is defined in part by a section of a periphery of the disintegrating roller;

drawing said flow of wood fibers from said disintegrating roller into a thin film; and sifting said fibers to remove coarse material therefrom by an air flow exerted on said wood fibers.

18. A process according to claim 17, wherein said sifting step is effected by the steps of:

directing said air flow upwardly through said flow of wood fibers to entrain said fibers and separate them from said coarse material; and deflecting said coarse material away from said fibers using a flap.

19. A process according to claim 17, wherein said disintegrating roller has a diameter between 500 mm and 600 mm and spins at a rate between 300 rpm and 2000 rpm.

20. A process according to claim 17, wherein said sifting step is effected by the steps of directing an air flow downwardly through said flow of wood fibers to entrain said fibers and separate them from said coarse material.

21. A process for disintegrating irregularities in a flow of wood fibers which are discharged from a metering device and designated for the production of fiberboards, said process comprising the steps of:

feeding said flow of wood fibers from said metering device through a feed chute to a spinning disintegrating roller having a plurality of pins extending outwardly therefrom;

deflecting said flow of wood fibers through contact with said pins;

directing said deflected wood fibers along a chute which is defined at least in part by a section of a periphery of the disintegrating roller and an opposite wall;

drawing said flow of wood fibers from said disintegrating roller into a thin film;

discharging said thin film from said chute through an outlet orifice in a substantially horizontal orientation;

sifting said fibers to remove coarse material therefrom by drawing a negative pressure to produce an air flow exerted in one of two directions, upwardly and downwardly, on said wood fibers thereby entraining said fibers, said coarse material being separated by gravity; and directing said coarse material to a coarse material outlet.

22. A process according to claim 21, wherein said sifting step is effected by the steps of:

directing an air flow upwardly through said flow of wood fibers to entrain said fibers and separate them from said coarse material; and deflecting said coarse material vertically downward away from said fibers using an angularly adjustable flap.

23. A process according to claim 21, wherein said disintegrating roller has a diameter between 500 mm and 600 mm and spins at a rate between 300 rpm and 2000 rpm.

24. A device for disintegrating irregularities in a flow of wood fibers, said device comprising:

a metering device having an outlet for discharging said fibers;

a feed chute positioned to receive said fibers discharged from said metering device;

a disintegrating roller positioned to receive said fibers from said feed chute, said roller being rotatable and having a plurality of pins extending outwardly therefrom;

a chute section defined by a sidewall positioned adjacent to said roller and a section of a periphery of said roller, said chute section extending around said roller in the direction of roller rotation, said fibers being deflected by impingement with said pins when said roller is rotating, said chute section having an outlet orifice for discharging said fibers therefrom;

an air duct positioned to direct an air flow into said fibers discharged from said chute section, said air flow separating said fibers from coarse material associated therewith, said air flow being exerted on said wood fibers in one of two directions, upwardly and downwardly, and a coarse material discharge chute having an outlet at one end and an inlet at an opposite end, said inlet being positioned facing said outlet orifice for receiving coarse material discharged from said chute section.

25. A device according to claim 24, wherein said air duct is oriented to direct said air flow in an upward direction into said fibers, said device further comprising an angularly adjustable flap positioned adjacent to said inlet for deflecting said coarse material into said coarse material discharge chute.

26. A device according to claim 24, wherein said pins have a tapered cross section extending in a direction outwardly from said roller, said pins having an end distal to said roller forming a point.

27. A device according to claim 24, wherein said sidewall comprises a hood being adjustable in position in relation to said roller.

28. A device according to claim 24 further comprising a spray nozzle positioned within seed chute, said nozzle being adapted to spray additives onto said fibers.

29. A device according to claim 24, wherein said air duct is oriented to direct said air flow in a downward direction into said fibers.

30. A device according to claim 24, wherein said air flow is produced by drawing a negative pressure.

* * * * *